United States Patent [19]

Tanabe et al.

[11] 4,244,756

[45] Jan. 13, 1981

[54] FIN STOCKS FOR USE IN HEAT EXCHANGER MADE OF ALUMINUM ALLOY AND PRODUCTION METHOD THEREOF

[75] Inventors: Zenichi Tanabe; Yoshio Baba, both of Nagoya; Toshiyasu Fukui, Toyoake; Satoshi Kimura, Nagoya, all of Japan

[73] Assignee: Sumitomo Light Metal Industries, Ltd., Tokyo, Japan

[21] Appl. No.: 21,631

[22] Filed: Mar. 19, 1979

[30] Foreign Application Priority Data

Mar. 22, 1978 [JP] Japan ..... 53-32773

[51] Int. Cl.[3] ..... C22C 21/06

[52] U.S. Cl. ..... 148/32; 75/140; 75/146; 75/147; 148/2; 148/11.5 A

[58] Field of Search ..... 75/147, 146, 140; 148/11.5 A, 2, 32

[56] References Cited

U.S. PATENT DOCUMENTS 3,337,377 8/1967 Bonmarin ..... 75/147

*Primary Examiner*—R. Dean

*Attorney, Agent, or Firm*—Blanchard, Flynn, Thiel, Boutell & Tanis

[57] ABSTRACT

The fin stocks for use in a heat exchanger made of aluminum alloy are made by use of an aluminum alloy having a sacrificial anode effect so that the fluid passage members of the heat exchanger are protected from corrosion electrochemically. A method for producing an aluminum alloy for use in the fin stocks is disclosed with the analysis of the function of each component of the aluminum alloy and determination of the ratio of each component in the alloy.

3 Claims, No Drawings

FIN STOCKS FOR USE IN HEAT EXCHANGER MADE OF ALUMINUM ALLOY AND PRODUCTION METHOD THEREOF

BACKGROUND OF THE INVENTION

The present invention relates to fin stocks for use in a heat exchanger made of aluminum alloy and more particularly to fin stocks for use in a heat exchanger made of aluminum alloy, which are resistant to drooping and serve as sacrificial anodes. The present invention also relates to a method for producing such fin stocks.

Conventionally, in an aluminum air-cooled heat exchanger, a brazing sheet comprising a core metal layer made of aluminum of corrosion-resistant aluminum alloy and a cladding metal layer made of Al-Si-base alloy or Al-Si-Mg base alloy formed on the core metal layer is applied to either a fluid passage member (tube or section) the cooling fins on the air side. However, when exposed to a severely corrosive atmosphere, pitting corrosion occurs in the wall of the heat exchanger on the air side by corrosion so that the fluid is apt to leak from the holes. Therefore, various surface processing methods for preventing such corrosion have been investigated and are used in practice. However, there is no perfect anticorrosion method. Some of the conventional methods are comparatively good, but have some problems from the economical point of view.

Furthermore, it is proposed that a material having a sacrificial anode effect be used in fin stocks for use in an aluminum air-cooled heat exchanger. As the conventional material for the sacrificial anode, AA7072 alloy is known. However, when AA7072 alloy is soldered in vacuum or under reduced pressure, Zn is evaporated and the sacrificial anode effect of the AA7072 alloy is not only reduced, but also the chamber for soldering is smeared or damaged by the evaporated alloy.

SUMMARY OF THE INVENTION

It is therefore an object of the present invention to provide a heat exchanger capable of resisting a severely corrosive atmosphere.

Another object of the present invention is to provide materials for use in the fin members of the heat exchanger, in which the above-mentioned shortcomings of the conventional material of sacrificial anodes are eliminated.

According to the present invention, as the cooling fins on the air side, a material which serves as a sacrificial anode is employed and the fluid passage members of the heat exchanger are protected from corrosion electrochemically, so that the heat exchanger is made corrosion-resistant against severely corrosive conditions.

In order to attain the above-mentioned objects of the present invention, the fin stocks are made of an aluminum alloy comprising 0.03 to 0.3 wt % of Sn, 0.03 to 0.08 wt % of Mg, 0.3 to 1.5 wt % of Mn and 0.1 to 0.8 wt % of Fe and at least one component selected from the group consisting of 0.01 to 0.3 wt % of Cr, 0.01 to 0.3 wt % of Zr, 0.01 to 0.3 wt % of Ti, 0.001 to 0.1 wt % of B, 0.01 to 0.8 wt % of Si, 0.01 to 0.8 wt % of Cu, 0.01 to 0.3 wt % of In and not more than 1 wt % of Zn, and the remainder consisting essentially of aluminum. In order to produce the fin stock, the alloy consisting of the above-mentioned components is subjected to casting and subsequently soaking at a temperature in the range of 400° to 600° C. for 1 to 24 hours when necessary and is formed into a 1.5 to 5 mm thick plate by hot rolling at the temperatures in the range of 400° to 550° C. and is then formed into a plate as thin as 0.05 to 0.3 mm by cold rolling and annealing.

DETAILED DESCRIPTION OF THE PREFERRED EMBODIMENTS

Referring to Table 1, there are shown the components of the aluminum alloys according to the present invention and those of the aluminum alloys to be compared with the alloys of the present invention.

The function of each component and the limited ratio of each component in the aluminum alloys according to the present invention are as follows:

Sn: This component serves to provide a sacrificial anode effect. When the ratio of this component is less than 0.03 wt %, the sacrificial anode effect is insufficient. On the other hand, when the ratio is more than 0.3 wt %, it becomes difficult to produce a large lump of the aluminum alloy and to perform rolling of the alloy, resulting in that quality control of the alloy products becomes difficult.

Mg: This component serves to improve hot rolling work of the aluminum alloy. But for Mg the rolling becomes practically almost impossible. In the presence of Sn, Mg forms $Mg_2Sn$, which improves the buckling strength of the aluminum alloy. When the ratio of Mg is less than 0.03 wt %, the effect of improving the buckling strength is not attained. On the other hand, when the ratio of Mg is more than 0.8 wt %, soldering of heat exchanger for practical use becomes difficult, resulting in that improper production of the heat exchanger product increases.

Mn: This component makes it easy to mold the fin stocks and improves the droop resistance of the fin members. When the ratio of Mn is less than 0.3 wt %, Mn does not have the above-mentioned effects. On the other hand, when the ratio of Mn is more than 1.5 wt %, a giant intermetallic compound is formed during casting, which deteriorates the surface condition of the fin stocks and reduces the sacrificial anode effect.

Fe: This component makes it easy to mold the fin stocks and improves the droop resistance of the fin members. Particularly, Fe has the effects in the presence of Mn. When the ratio of Fe is less than 0.1 wt %, the above-mentioned effects are insufficient. On the other hand, when the ratio is more than 0.8 wt %, a giant intermetallic compound is formed, so that rolling working and soldering of the fin members become difficult.

In and Zn: These two components serve to enhance the sacrificial anode effect. When the ratio of In is less than 0.01 wt %, the sacrificial anode effect is insufficient. With respect to both components, when the respective ratios exceed their respective upper limits, the components themselves corrode considerably. Particularly, in the case of Zn, when the ratio is more than 1 wt %, the alloy evaporates and scatters while soldering under reduced pressure or vacuum, so that the soldering chamber is smeared by the scattered Zn.

Cr and Zr: These components make it easy to mold the fin stocks and improve the droop resistance of the fin members. When the respective ratios are less than their respective lower limits, they do not have the effects, while they form giant intermetallic compounds above their upper limits, resulting in deteriorating the surface condition of the fin stocks.

Ti and B: These components serve to improve hot working of the fin stocks by making fine grain of the ingot aluminum alloy. When the ratios of these components are less than the respective lower limits, they do not have the above-mentioned effect. On the other hand, when the respective ratios exceed their upper limits, the components are crystallized as intermetallic compounds during casting of the aluminum alloy.

Si and Cu: These components improve the strength of the aluminum alloy and the droop strength of the fin members. They do not have the effects in the ratios below the respective lower limits, while above their respective upper limits, the sacrificial anode effect is reduced, and furthermore, the molding and soldering of the fin members becomes difficult.

Production of the fin members

1. Soaking of the alloy ingot is performed at temperatures in the range of 400° to 600° C. for 1 to 24 hours, and hot working of the fin stock is improved. Furthermore, Mn and Fe are made a solid solution, which serves to form uniform and fine precipitation during the working and heat treatment process. Occasionally, the soaking process can be omitted.

2. Hot tear cracking can be reduced by conducting hot rolling at temperatures in the range of 400° to 550° C., so that Sn and Mg that have been crystallized are made a solid solution of $Mg_2Sn$. During rolling, formation of the precipitated nucleus and fine particles of $Mg_2Sn$, Mn and Fe, which have been made solid solutions, proceeds.

3. The total amount of the cracked edges to be removed, which are formed during hot rolling and cold rolling, can be reduced by conducting the hot rolling to 1.5 to 5 mm, so that the proper production yield of the fin members can be increased.

4. A tough final product can be obtained by conducting cold rolling of a 1.5 to 5 mm thick plate to 0.05 to 0.3 mm. Annealing can be included in the process. Thus, molding and droop resistance of the fin members can be improved.

A heat exchanger made by using the fin stocks according to the present invention is soldered under an atmosphere below the vapor pressure of Mg (for example, 1 Torr at about 600° C.). In this case, Mg and Sn, which constitute $Mg_2Sn$, are separated and Mg evaporates, while Sn remains. In the case where $Mg_2Sn$ is distributed uniformly before soldering, Sn is distributed uniformly in fine particles so that good sacrificial anode effect can be obtained.

Referring to Table 2, there are shown the residual amount of Mg in each aluminum alloy when heated under various atmospheric pressures and the potential of each alloy in a 3% NaCl aqueous solution. When the aluminum alloys according to the present invention are heated in vacuum ($10^{-3}$ Torr) or at a reduced pressure ($10^{-1}$ Torr), the residual amount of Mg is small and the alloys tend to have negative potential.

Referring to Table 3, there are shown corrosion test results of the samples made by piling alternately by vacuum soldering the fin members made of the aluminum alloys of the present invention by Colgate work and the pipes made a brazing sheet whose core metal is A3003 alloy and whose cladding metal is made of AA×7 alloy.

In the case where the fin stocks of the alloy according to the present invention are employed, the corrosion of the heat exchanger pipe is significantly decreased, whereby the sacrificial anode effect of the alloys of the present invention can be confirmed.

Referring to Table 4, there are shown the molding and droop resistance of the fin members under application of heat at high temperatures. The molding of the fin members is evaluated by the occurrence of burrs at the cut portions at the time of louver processing and by the shape of the bent portions during Colgate work. The droop resistance is determined by measuring the drooping magnitude of the fin members after application of a heat of high temperature (soldering temperatures) with one end of a strip of each alloy plate fixed and with the other end free. The alloys produced according to the present invention droop little and have good droop resistance, and the rolling work is easy.

TABLE 1

Chemical Components of Aluminum Alloys of Present Invention and Those of Alloys for Comparison

| No. | Sn | Mg | Mn | Fe | Cr | Zr | Ti | B | Si | Cu | In | Zn | Al |
|---|---|---|---|---|---|---|---|---|---|---|---|---|---|
| 1 | 0.05 | 0.08 | 0.8 | 0.5 | | | | | | | | 0.3 | |
| 2 | 0.2 | 0.5 | 1.0 | 0.4 | | | | | | | 0.1 | | |
| 3 | 0.1 | 0.2 | 0.4 | 0.2 | 0.1 | | | | | | | | |
| 4 | 0.28 | 0.7 | 1.2 | 0.7 | | 0.2 | | | | | | | |
| 5 | 0.08 | 0.1 | 0.5 | 0.2 | | | 0.1 | | | | | | |
| 6 | 0.25 | 0.6 | 0.8 | 0.5 | | | | 0.01 | | | | | |
| 7 | 0.1 | 0.1 | 1.2 | 0.5 | | | | | 0.3 | | | | |
| 8 | 0.04 | 0.06 | 1.0 | 0.4 | | | | | | 0.2 | | | |
| 9 | 0.15 | 0.3 | 1.3 | 0.3 | 0.2 | 0.1 | | | | | | | |
| 10 | 0.2 | 0.4 | 0.5 | 0.7 | | | | | | 0.1 | 0.05 | | |
| 11 | 0.05 | 0.08 | 1.0 | 0.5 | | | | | 0.1 | | | 0.4 | |
| 12 | 0.15 | 0.1 | 0.7 | 0.6 | 0.15 | | 0.05 | 0.01 | | | | | |
| 13 | 0.1 | — | 1.0 | 0.3 | | | | | | | | | |
| 14 | 0.2 | 0.4 | — | — | | | | | | | | | |
| 15 | — | — | 1.2 | 0.5 | | | | | | | | | |

Note:
No. 1 ~ 12: Alloys according to the present invention.
No. 13 ~ 15: Alloys for comparison.

TABLE 2

Residual Amount of Mg and Potential Change Thereof after Heating for Soldering*

| | Residual Amount of Mg (Wt %) | | | Potential in 3% NaCl Aqueous Solution (V)** | | |
|---|---|---|---|---|---|---|
| No. | $10^{-5}$ Torr | $10^{-1}$ | 760 Torr | $10^{-5}$ Torr | $10^{-1}$ Torr | 760 Torr |
| 1 | 0.03 | 0.05 | 0.08 | −0.98 | −0.90 | −0.70 |
| 2 | 0.08 | 0.20 | 0.45 | −0.99 | −0.89 | −0.71 |

TABLE 2-continued

| | Residual Amount of Mg and Potential Change Thereof after Heating for Soldering* | | | | | |
|---|---|---|---|---|---|---|
| | Residual Amount of Mg (Wt %) | | | Potential in 3% NaCl Aqueous Solution (V)** | | |
| No. | $10^{-5}$ Torr | $10^{-1}$ | 760 Torr | $10^{-5}$ Torr | $10^{-1}$ Torr | 760 Torr |
| 3 | 0.05 | 0.10 | 0.21 | −0.92 | −0.87 | −0.70 |
| 4 | 0.10 | 0.25 | 0.60 | −0.90 | −0.80 | −0.68 |
| 5 | 0.02 | 0.05 | 0.10 | −1.10 | −0.90 | −0.70 |
| 6 | 0.08 | 0.32 | 0.55 | −0.91 | −0.80 | −0.67 |
| 7 | 0.02 | 0.06 | 0.10 | −0.99 | −0.89 | −0.70 |
| 8 | 0.01 | 0.04 | 0.06 | −1.12 | −0.90 | −0.71 |
| 9 | 0.10 | 0.10 | 0.28 | −0.92 | −0.86 | −0.70 |
| 10 | 0.08 | 0.20 | 0.37 | −0.90 | −0.79 | −0.68 |
| 11 | 0.01 | 0.05 | 0.08 | −1.10 | −0.90 | −0.72 |
| 12 | 0.02 | 0.07 | 0.1 | −1.05 | −0.89 | −0.70 |
| 13 | <0.01 | <0.01 | <0.01 | −1.15 | −1.15 | −1.12 |
| 14 | 0.10 | 0.20 | 0.36 | −0.90 | −0.80 | −0.69 |
| 15 | <0.01 | <0.01 | <0.01 | −0.63 | −0.63 | −0.62 |

Note:
*Soldering Condition:
600° C. × 5 min, $10^{-5}$ ~ 760 Torr
**Saturated Calomel Electrode Standard

TABLE 3

| | Corrosion Test Results* Maximum Corroded Depth (mm) | | |
|---|---|---|---|
| No. | Salt Spray Corrosion Test** | Alternating Dipping Test*** | CASS Test**** |
| 1 | 0.10 | 0.19 | 0.21 |
| 2 | 0.11 | 0.21 | 0.20 |
| 3 | 0.13 | 0.23 | 0.25 |
| 4 | 0.15 | 0.26 | 0.25 |
| 5 | 0.09 | 0.21 | 0.22 |
| 6 | 0.15 | 0.28 | 0.28 |
| 7 | 0.10 | 0.21 | 0.20 |
| 8 | 0.09 | 0.21 | 0.22 |
| 9 | 0.16 | 0.28 | 0.27 |
| 10 | 0.16 | 0.29 | 0.28 |
| 11 | 0.10 | 0.21 | 0.21 |
| 12 | 0.10 | 0.19 | 0.20 |
| 13 | 0.09 | 0.21 | 0.23 |
| 14 | 0.16 | 0.26 | 0.27 |
| 15 | 0.44 | 0.63 | 0.70 |

Note:
*Combination of Materials
Pipe: A3003 (Core Metal) - × 7 (Cladding Metal) Brazing sheet
Fin: No. 1 to No. 15 Alloy
**JIS . Z . 2371 for one month
***3% NaCl Aqueous Solution (PH = 3)
Dipping for 30 minutes at 40° C. and drying for 30 minutes at 50° C. This cycle is repeated for one month.
****JIS . H . 8681 for one month

TABLE 4

| | Rolling Work of Fin Stocks Molding and Droop Resistance of Fin Members | | |
|---|---|---|---|
| No. | Rolling Work* | Molding of Fin Members** | Droop Resistance*** |
| 1 | Good | Good | Good |
| 2 | " | " | " |
| 3 | " | " | " |
| 4 | " | " | " |
| 5 | " | " | " |
| 6 | " | " | " |

TABLE 4-continued

| | Rolling Work of Fin Stocks Molding and Droop Resistance of Fin Members | | |
|---|---|---|---|
| No. | Rolling Work* | Molding of Fin Members** | Droop Resistance*** |
| 7 | " | " | " |
| 8 | " | " | " |
| 9 | " | " | " |
| 10 | " | " | " |
| 11 | " | " | " |
| 12 | " | " | " |
| 13 | Occurence of Edge Crack | " | Droop |
| 14 | Good | Occurrence of Burr and Poor Beat Form | Considerable Droop |
| 15 | " | Good | Good |

Note:
*This is evaluated by the occurrence of edge cracks during hot rolling work.
**This is evaluated by the occurrence of burr during louver processing and by the bent form of the fin members during Colgate work.
***This is evaluated by the drooping magnitude of thefin members when heated at 600° C.

What is claimed is:

1. A fin stock for use in a heat exchanger, said fin stock being made of an aluminum alloy consisting essentially of 0.03 to 0.3 wt. % of Sn, 0.03 to 0.8 wt. % of Mg, 0.3 to 1.5 wt. % of Mn, 0.1 to 0.8 wt. % of Fe, at least one component selected from the group consisting of 0.01 to 0.3 wt. % of Cr, 0.01 to 0.3 wt. % of Zr, 0.01 to 0.3 wt. % of Ti, 0.001 to 0.1 wt. % of B, 0.01 to 0.8 wt. % of Cu, 0.01 to 0.3 wt. % of In and not more than 1 wt. % of Zn, and the remainder consisting essentially of aluminum, wherein said fin stock has a thickness of 0.05 to 0.3 mm and has been produced by the steps comprising:

casting said aluminum alloy to form a casting, hot rolling said casting at a temperature in the range of 400° to 550° C. to form a plate having a thickness of from 1.5 to 5 mm, and then cold rolling and annealing said plate to reduce the thickness thereof to from 0.05 to 0.3 mm.

2. A fin stock for use in a heat exchanger, said fin stock being made of an aluminum alloy consisting essentially of 0.03 to 0.3 wt. % of Sn, 0.03 to 0.8 wt. % of Mg, 0.3 to 1.5 wt. % of Mn, 0.1 to 0.8 wt. % of Fe, at least one component selected from the group consisting of 0.01 to 0.3 wt. % of Cr, 0.01 to 0.3 wt. % of Zr, 0.01 to 0.3 wt. % of Ti, 0.001 to 0.1 wt. % of B, 0.01 to 0.8 wt. % of Cu, 0.01 to 0.3 wt. % of In and not more than 1 wt. % of Zn, and the remainder consisting essentially of aluminum, wherein said fin stock has a thickness of 0.05 to 0.3 mm and has been produced by the steps comprising:

casting said aluminum alloy to form a casting and then soaking said casting at a temperature in the range of 400° to 600° C. for 1 to 24 hours, then hot rolling said casting at a temperature in the range of 400° to 550° C. to form a plate having a thickness of from 1.5 to 5 mm, and then cold rolling and annealing said plate to reduce the thickness thereof to from 0.05 to 0.3 mm.

3. A finned tube heat exchanger in which the fins are made of fin stock as claimed in claim 1 or claim 2 and the tubes are made of aluminum alloy.

* * * * *